United States Patent [19]

Weber

[11] 4,037,433

[45] July 26, 1977

[54] HAND KNITTING AID

[76] Inventor: Blanche V. Weber, 1350 Pontiac, Denver, Colo. 80220

[21] Appl. No.: 608,581

[22] Filed: Aug. 28, 1975

[51] Int. Cl.[2] ..... D04B 3/04; B65H 59/14

[52] U.S. Cl. ..... 66/1 A; 242/147 R

[58] Field of Search ..... 66/1 A, 4, 2, 1.5, 118, 66/149, 146, 125 R; 242/127, 149, 157 R, 153, 147 R

[56] References Cited

U.S. PATENT DOCUMENTS

| | | | |
|---|---|---|---|
| 1,208,085 | 12/1916 | Branley | 242/153 |
| 1,243,162 | 10/1917 | Gruman | 242/149 |
| 1,282,953 | 10/1918 | Sauer | 242/157 R |
| 2,133,221 | 10/1938 | White | 242/157 R |
| 2,155,753 | 4/1939 | Cook | 242/157 R |
| 2,244,903 | 6/1941 | Walk et al. | 242/153 |
| 2,472,702 | 6/1949 | Greenstein | 242/149 |
| 2,524,157 | 10/1950 | Beirer | 242/157 R |
| D. 59,449 | 10/1921 | Abate et al. | 242/149 |

FOREIGN PATENT DOCUMENTS

| | | | |
|---|---|---|---|
| 253,937 | 11/1912 | Germany | 242/157 |

*Primary Examiner*—Mervin Stein
*Assistant Examiner*—A. M. Falik
*Attorney, Agent, or Firm*—Richard D. Law

[57] ABSTRACT

A fingertip ring includes an extending member having a slot and a yarn opening therethrough for automatically tensioning yarn passing through the opening and used during manual knitting, crocheting, or the like.

2 Claims, 5 Drawing Figures

HAND KNITTING AID

Knitting, crocheting, etc. makes a type of cloth or clothing normally done with special needles and a yarn or a like material. This is differentiated from weaving using a frame holding the warp threads and includes a shuttle holding a woof thread for interlacing the materials to be woven. Knitting and crocheting may be performed manually with very simple tools, namely the needles, straight for the former and hooked for the latter. For manually knitting, crocheting, etc., yarn is pulled from a skein or ball, and passed through a hand and is then looped together in a variety of ways to form the type of cloth or piece of clothing, using needles to mainpulate the thread in the looping operation. The quality of the finished goods is, in a great measure, determined by the tension exerted on the yarn as it is looped and interlaced or interconnected with another loop of the yarn, etc. By looping the yarn around a finger of one hand, a user has a somewhat haphazard means of applying tension to the yarn during the movement of the needles.

The present invention relates to a fingertip-held, automatic yarn tensioning device for manual knitters, crocheters, etc., where such operations are performed by a person manually looping and interlacing yarn with special needles. The device is a fingertip ring preferably made of reasonably lightweight leather with an upstanding flange having a slitted opening therethrough. Yarn is passed through the opening to produce a uniform tension on the yarn as it is manipulated by the needles. The device may be made of different sizes for accommodation to different sizes of fingers or be made of an adjustable size if desired. The amount of tensioning on the yarn may be made by changing the size of the opening in the slit or by simply turning the ring to thereby increase or decrease tension on the yarn.

Included among the objects and advantages of the present invention is an automatic yarn tensioning device for manual knitting, crocheting, or the like.

Another object of the invention is to provide a ring for a fingertip having an apertured extension for passing yarn to manipulating needles providing automatic tensioning on the yarn passing the aperture of the device.

Another object of the invention is to provide a ringlet of leather having an upstanding extension and an apertured slot therethrough which yarn is passed to the manipulating needles of a manual operation so as to provide an automatic tension on the yarn passing into the needles.

A still further object of the invention is to provide a leather ringlet having an apertured extension for passing yarn to manipulating needles and for providing a variable tensioning of yarn passing through the aperture by angular movement of the extension in relation to a finger holding the ringlet.

These and other objects and advantages of the invention may be readily ascertained by referring to the following description and appended illustrations in which.

Figure 2:
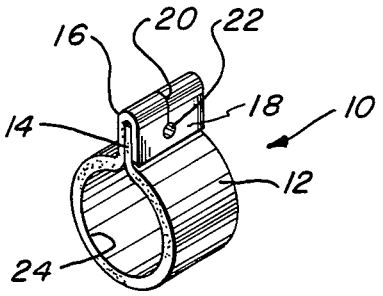
FIG. 2 is a perspective view of one form of the yarn tensioning device according to the invention.
Figure 3:
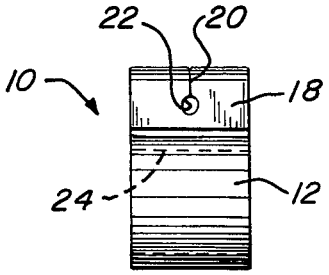
FIG. 3 is a side elevational view of the tensioner according to the invention.

In the device illustrated in FIGS. 2 and 3, the device, as shown in general by numeral 10, has a ringlet 12 formed of a strip of material having one end 14 extending generally radially, outwardly from a circular shape of strip while the other end has portion 16 and portion 18 folded back on itself around the upstanding end 14. The attachment between the ends 14 and 16 is secured by means of adhesive on both sides of the end 14 in face engagement with the inside of portions 16 and 18 to produce a ring with an extending portion. A slit 20 extends through the projecting portion, including the portions 16 and 18 and through the enclosed end 14 to an aperture 20 which extends through all three thicknesses of material. The ring 12 provides an opening 24 of a particular size which is arranged to fit a particular size of finger. For different sizes of fingers, the ring may be made larger or smaller or may be made adjustable by elastic or the like. Preferably the strip material is formed of a relatively lightweight strip of leather, which may be of a billfold thickness or the like, usually thick enough to support its configuration of a ring, and the width of the strip may be from one-fourth to 1 inch and preferably in the order of one-half to three-fourths of an inch. The slit 20 is normally cut with a thin knife to make a closed slit, while the opening 22 is drilled through the thicknesses of the leather. While leather is a preferred material for the formation of the device, various other materials may be utilized, such as plastic, metal and the like. The bore 22 should generally be rough so as to exert a slight pressure on any yarn passing therethrough so that on pulling the yarn, tension is incurred on the yarn. Leather makes a rough hole when drilled, while plastic, etc. must be roughened.

Figure 1:
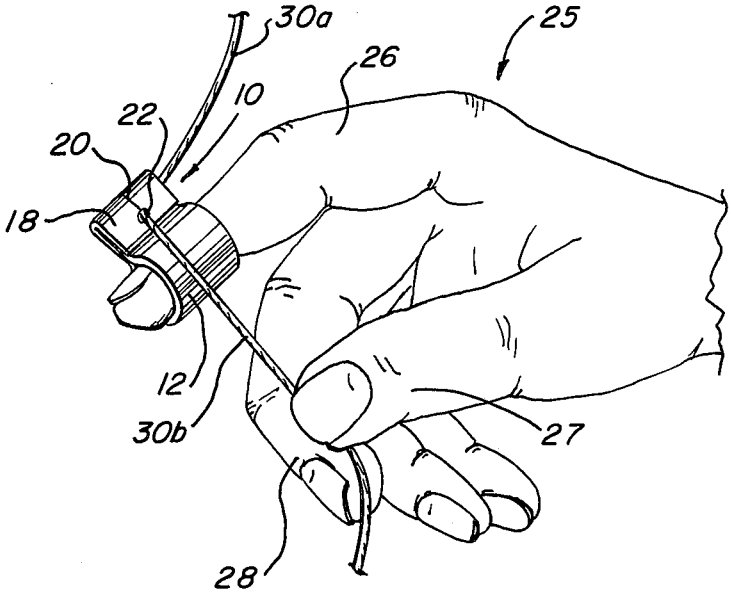
FIG. 1 is a generally perspective view of a yarn tensioning device according to the invention in operable position on a user's hand.

As shown in FIG. 1, a person'hand, shown in general by numeral 25, has the automatic tensioning device 10 mounted on the index finger 26. Yarn **30*a* from a skein or ball or the like, not shown, is passed through the opening 22 normally by forcing a portion of the yarn through a slit into the opening 22. A thumb 27 and middle finger 28 is used to hold the yarn for the needles, and as the yarn passes out of the tensioning device 10, a stretch 30*b* is tensioned depending upon the frictional fit of the yarn in the hole 22**. With leather the hole if rough and since yarn is bulky and loose, a friction fit occurs.

Figure 4:
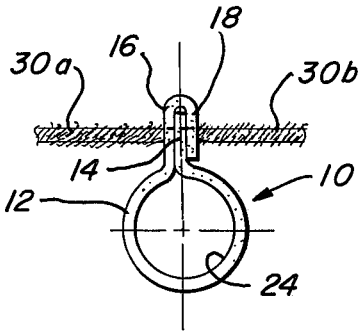
FIG. 4 is an end elevational view of the tensioner of the invention showing one position of tensioner of the invention during use.
Figure 5:
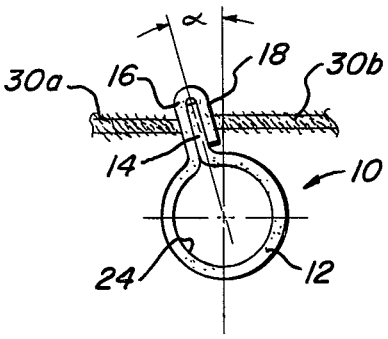
FIG. 5 is an end elevational view of the tensioner of the invention illustrating a different position to provide a different tensioning of yarn passing through the device.

As shown in FIG. 4, with the tensioning device mounted on a finger, not shown, in a generally upright position and the yarn passing generally perpendicular to the upright extension formed by the sides 16 and 18, the yarn **30*a* on passing through the opening is tensioned as to a yarn length 30*b* determined by the friction between the hole and yarn. As shown in FIG. 5, the tension on the yarn length 30*b* may be increased by tilting the extension to an angle alpha in relation to the yarn, which is usually a 5°–30° angle, or usually 15°–20°, so that additional friction and/or pressure is exerted on the yarn passing through the opening. If additional tension is desired, the tensioning device may be rotated somewhat more on the finger as desired. The use of the device shown in FIG. 1**, illustrates the possibility of positioning the tensioning device to change or vary the tension depending upon the yarn.

For most general purposes the hole 22 through the upright may be on the order of 1/16 inch, but may be changed to accommodate larger or smaller diameter yarn. For fine crocheting using a fine thread, the tensioning device may have a smaller opening 22, or the device may be rotated so that the thread is at an angle to the axis of the opening and, thus, producing tensioning. Further, the device may be made of a combination of material, e.g. a plastic ring with a leather extension, etc.

What is claimed is:

1. Yarn tensioning means for knitting and the like comprising:

a. ring-like support means for mounting adjacent a fingertip of a user;

b. leather flange means upstanding generally radially from said ring-like support means, extending a distance from said support means;

c. there being a bore through said leather means with a rough interior surface to induce friction on yarn passing therethrough; and d. there being a slit extending into said flange means providing a yarn ingress to said bore.

2. Yarn tensioning means according to claim 1 wherein said support means is arranged to be secured in position with said flange means extending from the back of a user's finger.

* * * * *